US006807792B2

(12) United States Patent
Sevcik et al.

(10) Patent No.: US 6,807,792 B2
(45) Date of Patent: Oct. 26, 2004

(54) SPOUT SINGULATOR FOR CLOSURE FEED SYSTEM

(75) Inventors: Petr Sevcik, Bristol, WI (US); Stefan Annehed, Chicago, IL (US); Hisami Mitsuishi, Buffalo Grove, IL (US); Sheila Moss, Barrington, IL (US); Ken Pokusa, Willowbrook, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/739,164

(22) Filed: Dec. 18, 2000

(65) Prior Publication Data

US 2002/0073648 A1 Jun. 20, 2002

(51) Int. Cl.[7] ..... B65B 61/18

(52) U.S. Cl. ..... 53/133.2; 53/412; 493/87; 493/102; 221/298

(58) Field of Search ..... 53/133.2, 133.4, 53/412; 493/87, 10–14, 102; 221/298, 299

(56) References Cited

U.S. PATENT DOCUMENTS 3,908,341 A * 9/1975 Conti ..... 53/314
4,930,290 A * 6/1990 Barker ..... 53/456
5,267,934 A * 12/1993 Pape et al. ..... 493/87
5,484,374 A * 1/1996 Bachner et al. ..... 53/133.2
6,066,081 A * 5/2000 Bachner ..... 493/102

* cited by examiner

*Primary Examiner*—Eugene Kim
*Assistant Examiner*—Thanh Truong
(74) *Attorney, Agent, or Firm*—Welsh & Katz, Ltd.

(57) ABSTRACT

A closure feed system for use on an associated form, fill and seal packaging machine for feeding and singulating closures from a closure storage region to a closure applicator. The feed system includes a chute for conveying the closures from the storage region to the applicator along a conveyance path defined by the chute. A singulator includes upper and lower reciprocating members configured for alternatingly reciprocating into and out of the conveyance path. The upper member includes a separating element having an upper surface and a lower surface. One of the upper and lower surfaces is formed at an incline relative to the other surface such that a distance between the upper and lower surfaces increases as the lower member moves into the conveyance path.

22 Claims, 4 Drawing Sheets

SPOUT SINGULATOR FOR CLOSURE FEED SYSTEM

BACKGROUND OF THE INVENTION

The present invention pertains to a singulator for closures in a closure feed system. More particularly, the present invention pertains to a singulator for a closure feed system for use in a form, fill and seal packaging machine in which closure are mounted to the package.

Many of today's containers such as cartons are formed or made having spouts mounted thereto. For example, many of today's gable-top cartons include resealable spouts that are mounted to one of the gable panels to facilitate dispensing the contents from the carton and resealing the carton after use.

In the forming, filling and sealing operation of a packaging machine, the spouts must be mounted to the cartons in concert with the overall operation of the machine. To this end, these machines include applicator stations at which a spout is dispensed to an applicator and moved into contact with the carton. The applicator typically includes some form of sealing device, such as an ultrasonic sealing or welding head that moves into contact with the carton while the closure rests on an anvil that is also moved into contact with the carton. Energy is then transmitted from the sealing head into the carton material above the spout to seal the spout thereto.

In that many modern packaging machines operate at high speeds (some of which operate at speeds up to about 14,000 packages per hour), one concern is that the spouts or closures must be dispensed at a rate commensurate with the overall packaging machine speed, while accurately and precisely dispensing these closures for proper positioning within the applicator. It has been found that the spouts can clog or bottleneck in known dispensing arrangements thus slowing or requiring that the machine be shut down in order to free up the spouts at the dispensing location. A particular phenomena known as shingling occurs in which the thin closure flanges overlap one another and cause skewing of closures. This in turn causes the closures to jam within the feed system.

Typically, in closure feed systems, the spouts fall, by gravity, through a chute on to a reciprocating anvil in the applicator system. It has been found that shingling occurs and jams these systems, by clogging the chutes when more than one closure drops into position for receipt on the anvil.

Accordingly, there exits a need for a closure feed system that prevents the bottlenecking that may occur in the closure feed system. Desirably, such a closure feed system dispenses a single closure at a time for receipt by the anvil. More desirably, such a system singulates the closures or spouts for subsequent passage to and receipt on the applicator anvil. Most desirably, such a system singulates the closures and urges a lower closure from its adjacent upper closure for subsequent passage to the applicator anvil.

BRIEF SUMMARY OF THE INVENTION

A closure feed system for use on an associated form, fill and seal packaging machine feeds and singulates closures from a closure storage region to a closure applicator. The feed system overcomes known problems associated with closure shingling by urging the closures from one another and provides a force, over and above that of gravity to urge the closures, individually, to the closure applicator.

The feed system includes a chute for conveying the closures from the storage region to the applicator. The chute defines a conveyance path. The feed system further includes a singulator having upper and lower reciprocating members. In a preferred embodiment, the reciprocating members are formed as upper and lower plungers. The plungers are configured for alternatingly reciprocating into and out of the conveyance path.

The lower member includes a separating element having an upper surface and a lower surface. Preferably, the separating element is formed as a wedge. The lower surface of the wedge is formed at an incline or angle relative to the upper surface such that a distance between the upper and lower surfaces increases as the wedge moves into the conveyance path.

In a preferred embodiment, the angle between the upper and lower surfaces of the wedge is about 10 degrees to about 30 degrees. Most preferably, the angle is angle is about 20 degrees. The wedge can include a curved head portion and a concavity formed in the head to facilitate easing the wedge between adjacent, respective closures.

The reciprocating plungers can be first and second pneumatic cylinders for reciprocating the upper and lower reciprocating members. The cylinders and plungers can be mounted to a same side of the conveyance path to facilitate routing of pneumatic piping and/or tubing.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
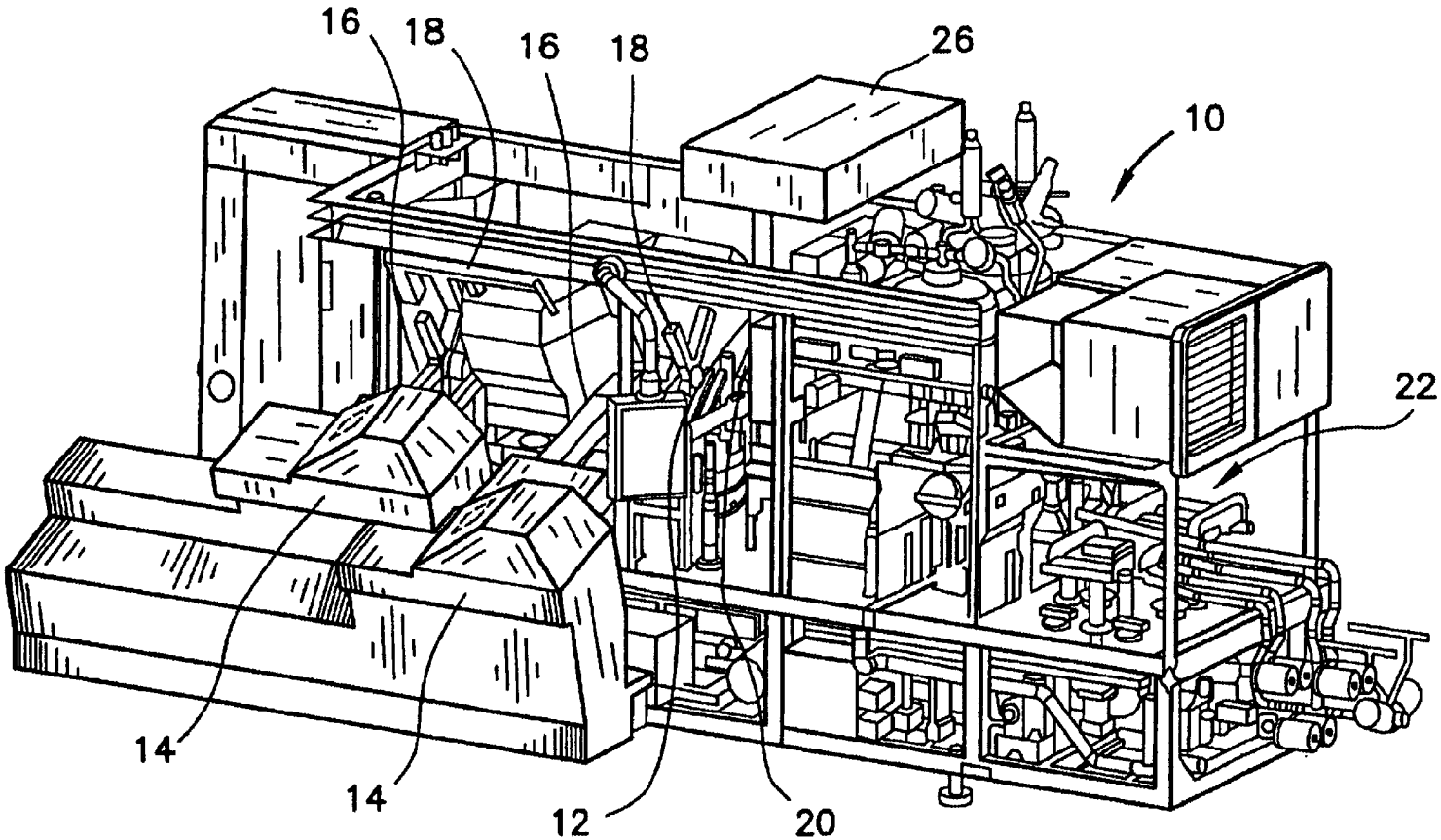
FIG. 1 is a perspective view of an exemplary form, fill and seal packaging machine having a closure applicator system and a closure feed system embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this application ("Detailed Description Of The Invention") relates to a requirement of the United States Patent Office, and does not imply, nor should be inferred to limit the subject matter disclosed herein.

Referring to the figures and in particular to FIG. 1, there is shown a typical form, fill and seal packaging machine 10. The packaging machine 10 includes a closure feed system, indicated generally at 12, embodying the principles of the present invention. A typical form, fill and sealing packaging machine 10 includes a carton magazine 14 for storing flat, folded cartons prior to erection. The machine 10 further includes a carton erection station 16, a bottom flap sealing station 18 and a closure applicator station 20. Subsequent to application of the closures, the carton may be sterilized, filled and subsequently sealed at a top panel sealing station 22 to form the well-known and well recognized carton gable-top. The cartons are then off loaded from the machine 10. The construction and design of an exemplary machine is disclosed in Katsumata, U.S. Pat. No. 6,012,267, which patent is assigned to the assignee of the present invention and which patent is incorporated herein by reference for purposes of the that patent's disclosure of such a machine.

Figure 2B:
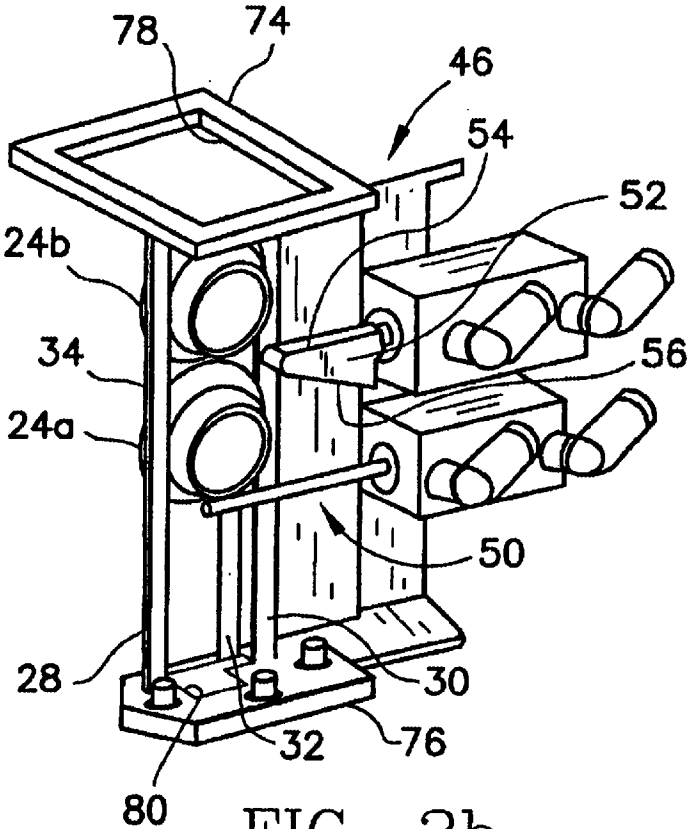
FIGS. 2*a* and 2*b* are perspective views of a closure feed system having a closure singulator embodying the principles of the present invention, the singulator being shown with closures positioned within the feed system chute, FIG. 2*a* illustrating the upper plunger in the extended position with a wedge positioned between adjacent, respective closures, and the with lower plunger in the retracted position, and FIG. 2*b* illustrating the upper plunger in the retracted position with the wedge removed from between adjacent, respective closures, and the with lower plunger in the extended position supporting the closures.
Figure 2A:
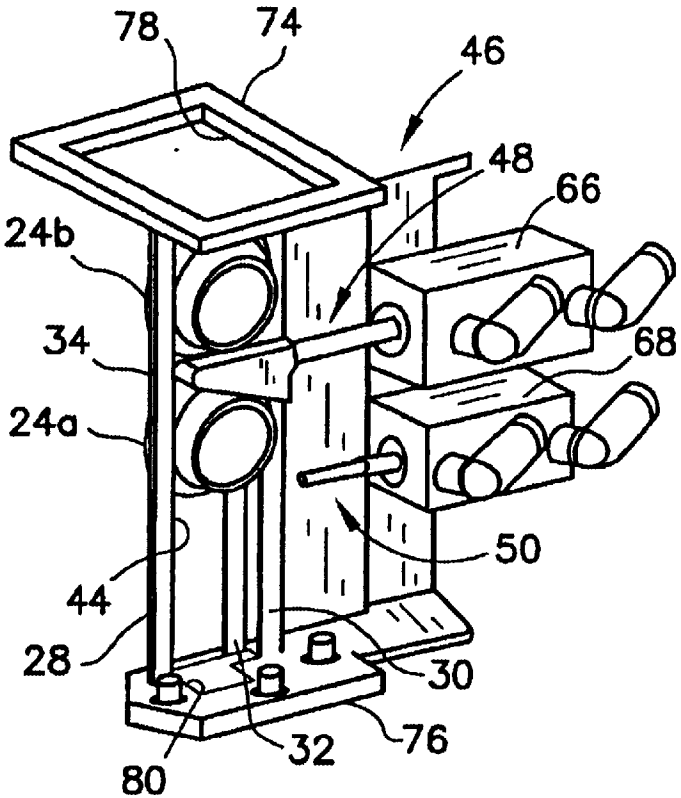
Figure 6:
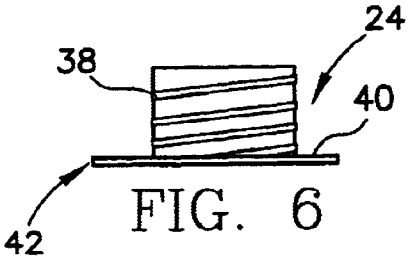
FIG. 6 illustrates an exemplary closure that can be fed using the present closure feed system.

Referring now to FIG. 1, closures 24 are fed from a closure storage unit 26, such as a bin, into the closure feed system 12. As seen in FIGS. 2*a* and 2*b*, the closure feed system 12 includes a plurality of rails 28, 30, 32, 34 that define a chute 36 for the closures 24. A typical closure 24, as illustrated in FIG. 6, includes a spout 38 that extends upwardly from one side 40 of a flange 42. The flange 42 has a diameter $d_f$ that is substantially larger than a diameter $d_s$ the spout 38.

Figure 3:
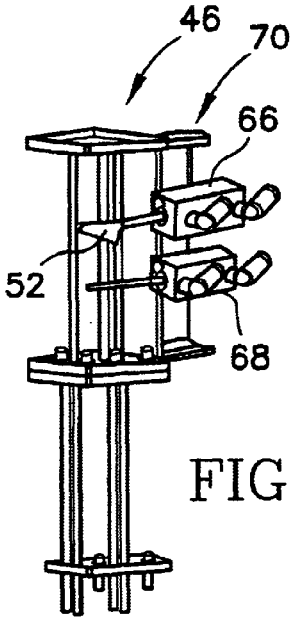
FIG. 3 is a view of the singulator system similar to that shown in FIGS. 2*a* and 2*b* the singulator system being shown without closures positioned therein for clarity of illustration.

Referring to FIGS. 2–3, in the chute 36, the rails 28–34 bound the sides of the flange 42, that reside on outer portions of the upper and lower surfaces of the flange 42 thus defining a pathway P for conveying the closures 24. The closures 24 move through the chute 36 with the spouts 38 extending through an opening or gap between rails 28 and 30, as indicated at 44.

A singulator 46 includes a pair of reciprocating rods or plungers, shown as upper plunger 48 and lower plunger 50. The plungers 48, 50 reciprocate in opposing manner to one another. That is, as seen in FIG. 2*b*, when upper plunger 48 is in the retracted position, lower plunger 50 is in the extended position. Conversely, as seen in FIG. 2*b*, when lower plunger 50 is in the retracted position, upper plunger 48 is in the extended position. The plungers 48, 50 extend into and retract from the closure conveyance path P, as defined by the chute 36.

The upper plunger 48 is the stop for a line of closures that are within the chute 36. The upper plunger 48 includes a plunger wedge 52 mounted thereto. As seen in FIGS. 5*a–d*, the plunger wedge 52 includes a first, generally horizontal upper surface 54 and a lower, angled or inclined surface 56. A preferred inclined surface 56 is at an angle $\alpha$ of about 10 degrees to about 30 degrees to the upper surface 54. In a present embodiment, the angle $\alpha$ is about 19 degrees. The line of closures 24 rest on the upper surface 54.

The plunger wedge 52 is configured such that as it moves from the retracted position (FIG. 2*b*) to the extended position (FIG. 2*a*), i.e., into the closure pathway P, the distance $d_p$ between the upper and lower surfaces 54, 56 increases. In this manner, as will be described below, as the plunger wedge 52 moves into or between respective upper and lower closures 24*b*, 24*a*, the distance between the closures 24*b*, 24*a* increases, thus separating them to "unshingle" the flanges 42*b*, 42*a* from one another. For purposes of this discussion, the upper closure 24*b* is that closure that is to remain within the line of closures in the chute 36, and the lower closure 24*a* is that closure that is to be dispensed to the applicator anvil (not shown).

The plunger wedge 52 can further include a rounded head portion 58. In a current embodiment, the head 52 has a radius of curvature of about 3 millimeters (mm). The head 58 can further include a concave or recessed region 60 at the end thereof. The rounded head portion 58 and concavity 60 further facilitate easing the wedge 52 between the respective adjacent upper and lower closures 24*b*, 24*a*, to reduce or eliminate the potential for crushing the closures 24*a*, 24*b* as the wedge 52 is urged between them. The wedge 52 can be secured to the plunger 48 by a pin 62 that inserts through an opening 64 formed in the body of the wedge 52.

As set forth above, one of the problems encountered in currently known closure feed systems is that the flanges tend to shingle as the closures reside within the chute, between the rails. To this end, the present singulator 46 overcomes these problems by providing an additional force over and above that of gravity to help move the closures 24 through the chute 36.

Referring to FIGS. 2*a* and 2*b*, in operation, the plungers 48, 50 reciprocate in an opposing manner to one another. That is, as seen in FIG. 2*b*, the lower plunger 50 is in the extended position while the upper plunger 48, with the wedge 52, is in the retracted position. In this manner, the closures 24*a*, 24*b* are prevented from falling through the chute 36 by the lower plunger 50. Referring now to FIG. 2*a*, the plunger positions are then reversed with the upper plunger 48 moving to the extended position between respective, adjacent upper and lower closures 24*b*, 24*a*. As the upper plunger 48 moves to the extended position, the lower plunger retracts 50. This permits the lower closure 24*a* to fall through the chute 36. The upper surface 54 of the wedge 52 contacts a lower portion of the upper closure 24*b* to provide a stop to prevent the upper closure 24*b* (and those closures above it) from falling through the chute 36.

At the same time, the lower, inclined or angled surface 56 of the wedge 52 contacts an upper portion of the lower closure 24*a*. If the flanges 42*b*, 42*a* of the upper and lower closures 24*b*, 24*a* are shingled with one another, this could prevent the lower closure 24*a* from falling through the chute 36. Continued extension of the upper plunger 48 urges the wedge 52 inwardly to separate the upper and lower closures 24*b*, 24*a* from one another, by pushing down on or urging the lower closure 24*a*, thus "unshingling" the closure flanges 42*b*, 42*a*. This, as will be understood from the drawings, urges the lower closure 24*a* down through the chute 36 thus singulating the closures 24.

At this point in the operation cycle, the upper closure 24*b* is resting on the top surface 54 of the upper plunger wedge 52, and the lower closure 24*a* has fallen through the chute 36 to the applicator anvil. The plunger 48, 50 positions then reverse, with the lower plunger 50 extending to support or prevent passage of the closures 24 and the upper plunger 48 retracting. The plungers 48, 50 then cycle once again with the lower plunger 50 retracting and the upper plunger 48 with the wedge 52 extending to singulate the next successive pair of adjacent closures 24.

In a current embodiment, the plungers or rods 48, 50 are driven by pneumatic cylinders 66, 68. The cylinders 66, 68 are connected to, i.e., plumbed from a common air source (not shown). It will, however, be recognized that the cylinders 66, 68 are connected to the air source in opposing relation to one another. That is, a feed line to one side of the upper plunger cylinder 66 will feed the opposite side of the lower plunger cylinder 68. In this manner, the plungers 48, 50 are configured to cycle in opposing relation to one another. This may result in a "lag" in actuation of the plungers 48, 50 as a result of the reaction time of the plungers 48, 50 vis-à-vis the pneumatics of the cylinders 66, 68. Other timing and/or coordination measures may be taken to assure that the closure feed system 12 is properly timed with the overall function and operation of the form, fill and seal packaging machine 10. Those skilled in the art will also recognize the various other drive arrangements that can be used for the present feed system 12, which other drive arrangements are within the scope and spirit of the present invention.

Figure 4:
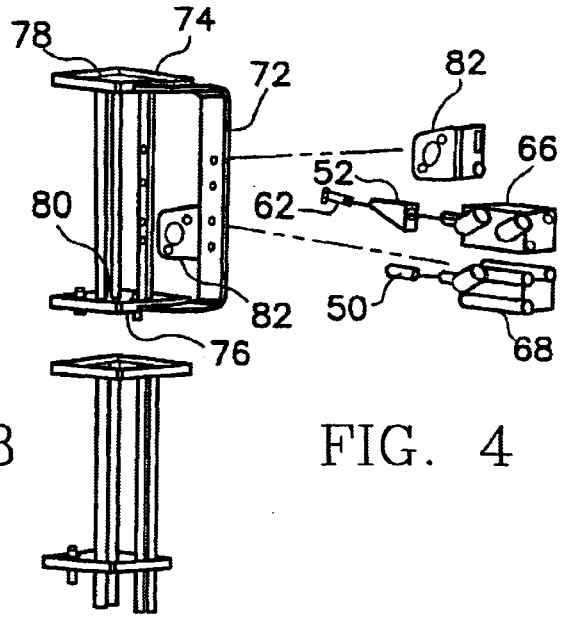
FIG. 4 is an exploded view of the singulator system of FIG. 3.
Figure 5A:
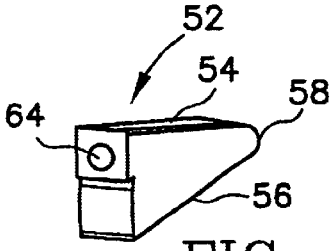
FIGS. 5*a–d* are front and rear perspective views, a top view and a cross-sectional view of the wedge member of the present closure singulator system, FIG. 5*d* being taken along line 5*d*—5*d* of FIG. 5*c*.
Figure 5C:
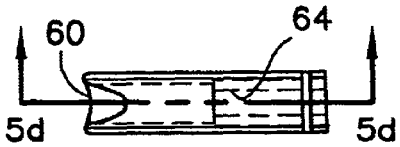
Figure 5B:
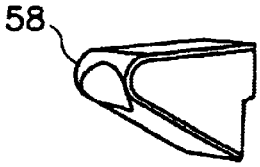
Figure 5D:
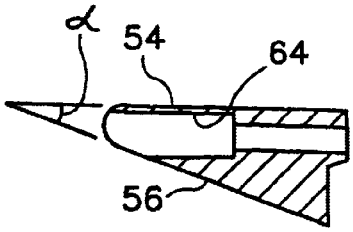

Referring now to FIG. 4, the plungers 48, 50 and cylinders 66, 68 are mounted to the feed system 12 by a mounting assembly 70 as will be readily recognized by those skilled in the art. The assembly 70 can include first brackets 72 mounted to upper and lower support plates 74, 76. The plates 74, 76 have openings 78, 80 therein for passage of the closures 24. Angle brackets 82 can be used to support the cylinders 66, 68, and can be configured to permit readily adjusting the position of the cylinders 66, 68 and thus the plungers 48, 50 to permit accurate positioning of the plungers 48, 50 within the chute 36. Other mounting arrangements will be readily recognized by those skilled in the art. It will also be recognized that although the cylinders 66, 68 are shown mounted to a common side of the chute 36, this too can be modified for a desired machine configuration and design.

Figure 7:
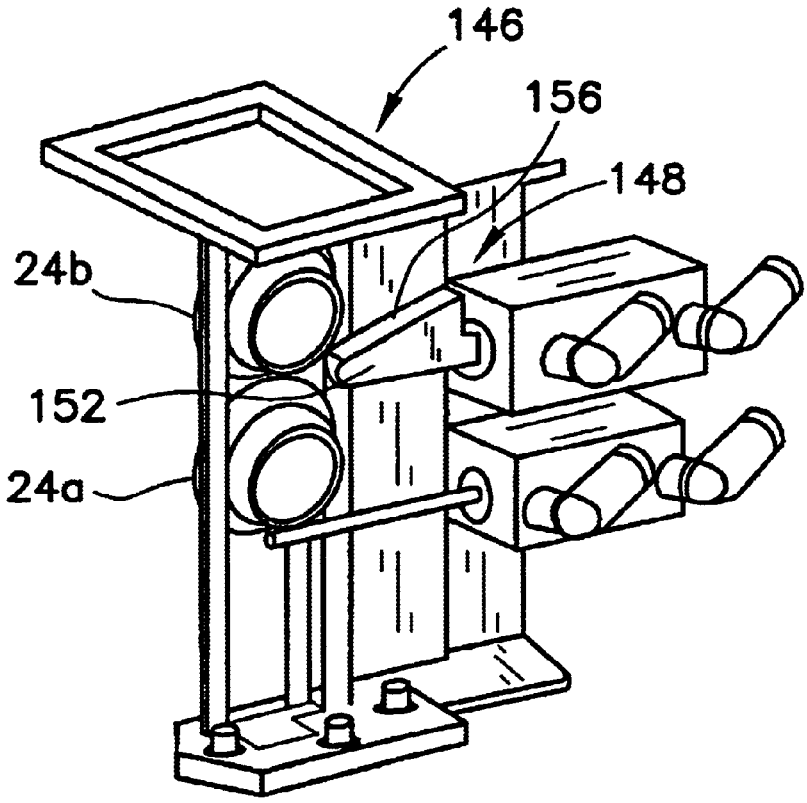
FIG. 7 illustrates an alternate embodiment of the closure singulator system in which the wedge is mounted in an opposing manner to that shown in FIGS. 2–4.

FIG. 7 illustrates an alternate embodiment of the singulator 146 in which the upper plunger 148 includes a wedge 152 that is mounted in opposing relation to that shown in FIGS. 2–4. That is, the wedge 152 is mounted upside-down with the inclined surface 156 oriented upwardly rather than downwardly. In this orientation, the inclined surface 156 urges the upper closure 24*b* upwardly to unshingle from the lower closure 24*a*.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A closure feed system for use on an associated form, fill and seal packaging machine for feeding and singulating closures from a closure storage region to a closure applicator, the feed system comprising:

a chute for conveying the closures from the storage region to the applicator, the chute defining a conveyance path; and a singulator, the singulator including upper and lower reciprocating members, the members configured for alternatingly reciprocating into and out of the conveyance path, only one of the upper and lower members including a separating element having an upper surface and a lower surface, one of the upper and lower surface being formed at an incline relative to the other of the surfaces such that a distance between the upper and lower surfaces increases as the member moves into the conveyance path, wherein the separating element is a wedge having a curved head portion including a concavity formed therein, and wherein the wedge is configured for insertion between adjacent closures and wherein the upper and lower surfaces are configured to contact the adjacent closures to separate the adjacent closures from one another.

2. The closure feed system in accordance with claim 1, wherein the wedge define, upper and lower surfaces formed at an angle relative to one another.

3. The closure feed system in accordance with claim 2, wherein the angle is about 10 degrees to about 30 degrees.

4. The closure feed system in accordance with claim 3, wherein the angle is about 20 degrees.

5. The closure feed system in accordance with claim 1, wherein the upper and lower reciprocating members are configured as reciprocating plungers.

6. The closure feed system in accordance with claim 1, wherein upper and lower reciprocating members are mounted to a same side of the conveyance path.

7. The closure feed system in accordance with claim 6, wherein the first and second cylinders are pneumatic cylinders.

8. The closure feed system in accordance with claim 1, including first and second cylinders for reciprocating the upper and lower reciprocating members.

9. The closure feed system in accordance with claim 1, wherein the upper surface is formed at an incline to the lower surface.

10. The closure feed system in accordance with claim 1 wherein the lower surface is formed at an incline to the upper surface.

11. The closure feed system in accordance with claim 1 wherein the upper member includes the separating element.

12. A form, fill and seal packaging machine for forming, filling and sealing packages, the packages having a spout mounted thereto, comprising:

a carton magazine;

a carton erection station;

a closure applicator station including a closure storage region and a closure applicator, the applicator station including a chute for conveying the closures from the storage region to the closure applicator, the chute defining a conveyance path, the applicator station including a singulator having upper and lower reciprocating members configured for alternatingly reciprocating into and out of the conveyance path, only one of the upper and lower members including a separating element having an upper surface and a lower surface, one of the upper and lower surfaces being formed at an angle relative to the other of the surfaces such that a distance between the upper and lower surfaces increases as the member moves into the conveyance path, wherein the separating element is a wedge having a curved heed portion including a concavity formed therein, the wedge being configured for insertion between adjacent closures and wherein the upper and lower surfaces are configured to contact the adjacent closures to separate the adjacent closures from one another;

a filling station; and a top sealing station.

13. The form, fill and seal packaging machine in accordance with claim 12, wherein the wedge defines upper and lower surfaces formed at an angle relative to one another.

14. The form, fill and seal packaging machine in accordance with claim 13, wherein the angle is about 10 degrees to about 30 degrees.

15. The form, fill and seal packaging machine in accordance with claim 14, wherein the angle is about 20 degrees.

16. The form, fill and seal packaging machine in accordance with claim 12, wherein the upper and lower reciprocating members are configured as reciprocating plungers.

17. The form, fill and seal packaging machine in accordance with claim 12, wherein the upper and lower reciprocating members are mounted to a same side of the conveyance path.

18. The form, fill and seal packaging machine in accordance with claim 12, including first and second cylinders for reciprocating the upper and lower reciprocating members.

19. The form, fill and seal packaging machine in accordance with claim 18, wherein the first and second cylinders are pneumatic cylinders.

20. The form, fill and seal packaging machine in accordance with claim 12 wherein the upper surface is formed at an incline to the lower surface.

21. The form, fill and seal packaging machine in accordance with claim 12, wherein lower surface is formed at an incline to the upper surface.

22. The form, fill and seal packaging machine in accordance with claim 12 wherein the upper member includes the separating element.

* * * * *